US005134871A

United States Patent [19]

Makino et al.

[11] Patent Number: 5,134,871

[45] Date of Patent: Aug. 4, 1992

[54] CYLINDER LOCK

[75] Inventors: Toshikazu Makino, Otake; Satoru Gokuda, Higashihiroshima; Isao Ochi; Takashi Kawamoto, both of Hiroshima, all of Japan

[73] Assignee: U-Shin Ltd., Tokyo, Japan

[21] Appl. No.: 600,804

[22] Filed: Oct. 22, 1990

[30] Foreign Application Priority Data

| | | | |
|---|---|---|---|
| Oct. 20, 1989 | [JP] | Japan | 1-271474 |
| Oct. 20, 1989 | [JP] | Japan | 1-271475 |
| Mar. 15, 1990 | [JP] | Japan | 2-65057 |
| Apr. 20, 1990 | [JP] | Japan | 2-102851 |

[51] Int. Cl.[5] ..... E05B 29/06

[52] U.S. Cl. ..... 70/492; 70/377; 70/419

[58] Field of Search ..... 70/376, 377, 392, 492, 70/495, 496, 419, 421

[56] References Cited

U.S. PATENT DOCUMENTS

| | | | |
|---|---|---|---|
| 148,274 | 3/1874 | Wolf | 70/492 X |
| 1,960,263 | 5/1934 | Fitzgerald | 70/492 |
| 1,979,939 | 11/1934 | Jacobi | 70/492 |
| 3,167,944 | 2/1965 | Pickering | 70/492 X |
| 4,292,823 | 10/1981 | Reinhard et al. | 70/492 |

FOREIGN PATENT DOCUMENTS

| | | | |
|---|---|---|---|
| 3143638 | 5/1983 | Fed. Rep. of Germany | 70/492 |
| 0025800 | 3/1953 | Finland | 70/492 |
| 1391202 | 1/1965 | France | 70/377 |
| 1544342 | 9/1968 | France | 70/419 |

*Primary Examiner*—Lloyd A. Gall

*Attorney, Agent, or Firm*—Wenderoth, Lind & Ponack

[57] ABSTRACT

A cylinder lock has a cylinder lock holder with a rotor rotatably disposed therein. The rotor has a plurality of grooves, with a plurality of tumblers slidably disposed in the grooves. Holder grooves are provided in the cylinder lock holder for receiving the tumblers projecting out of the grooves of the rotor. The rotor is able to be rotated in the cylinder lock holder in response to the insertion of a key into the rotor by causing the tumblers to be retracted from the holder grooves. Rotation is disabled when the key is removed, the tumblers projecting back into the holder grooves under the action of a spring biasing the tumblers. The key is inserted through a plurality of key insertion holes in the tumblers. Tooth portions are formed at respective contact portions between the tumblers and the inner surface of the cylinder lock holder, the respective tooth portions being engaged with each other when the key is removed from the lock.

5 Claims, 6 Drawing Sheets

CYLINDER LOCK

BACKGROUND OF THE INVENTION

The present invention generally relates to a tumbler type of cylinder lock where turning the lock without the proper key is impossible to effect, and more particularly, to a tumbler type cylinder lock where it is difficult to manufacture a duplicate lock by reading the heights of the tumblers.

Cylinder locks, which are widely used in, for example, motorcar doors and key switch portions or building doors or the like, have a pivotal rotor provided within a holder, and, a plurality of tumblers retained within the rotor. When a key is removed, the pivoting of the rotor becomes impossible to effect, because the tumblers are projected into a groove in the inner peripheral face of the holder. When the key is inserted, the pivoting of the rotor is enabled because the tumblers are engaged within the rotor.

FIGS. 9 through 12 show a conventional example of the construction of this type of cylinder lock. A rotor 2 is pivotally accommodated in a holder 1. A spring 4 and a tumbler 5, urged in a direction so as to be externally projected from an external peripheral face 2*a* of the rotor 2 by the spring 4, are slidably accommodated within a key groove 3 of the rotor 2. When a key 6 is removed, a lock portion 5*b* of the tumbler 5 is adapted to be projected into a groove 1*b* of the holder 1 from the external peripheral face 2*a* of the rotor 2, in a position where a contact portion 5*a* of the tumbler 5 is in contact with an inner peripheral face 1*a* of the holder 1. Although the projection amount at this time is regulated by the contact of the contact portion 5*a* of the tumbler 5 against the inner peripheral face 1*a* of the holder 1, the projection amount becomes the same in size as a plurality of tumblers 5 are the same in the outer shape thereof. As shown in FIG. 11 and FIG. 12, the key insertion hole 5*c* is not the same in position for each tumbler 5, but is provided at respective position-corresponding to the height on the corresponding key. When the key 6 has been inserted as far as the given position, the key insertion hole 5*c* is pushed by a mountain 6*a* of the key 6, and the tumbler 5 moves so that the tip end of the lock portion 5*b* is adapted to be retracted as far as the external peripheral face of the rotor 2.

FIG. 9 is a drawing showing the position of the tumbler 5 with the key 6 being drawn out, with the respective tumblers 5 arranged in alternating directions reversed to each other, within the rotor 2. When the key 6 has been drawn out, each tumbler 5 to be projected in the same direction moves to the same position, with the position of the key insertion hole 5*c* becoming a position corresponding to the key mountain 6*a*. When the key 6 has been inserted as shown in FIG. 10, all the tumblers 5 are pushed by the corresponding key mountains, are moved respectively as far as a position where the lock portion 5*b* is not projected, and are engaged into the rotor 2, thus allowing the rotor 2 to be pivoted.

As the position of the key insertion hole 5*c* when the key 6 has been drawn out corresponds to the height of the corresponding key mountain 6*a* in the conventional construction as described hereinabove, a duplicate lock may be made by the reading of the position of the key insertion hole 5*c* of each tumbler 5 with, for example, a magnifying endoscope, so that the safety of the key 6 is damaged. Also, as the movement amount of each tumbler 5 is the same, the rotor 2 may be picked by clockwise rotation of the rotor 2 from the condition of, for example, FIG. 11 so as to depress the tumblers 5 one by one against the urging force of the spring 4, riding the lock portion 5*b* on the end portion 1*c* on the side of the groove 1*b* of the inner peripheral face 1*a* of the holder 1. Thus, this point becomes also a factor of lowering the safety of the key 6.

SUMMARY OF THE INVENTION

Accordingly, the present invention has been developed with a view to substantially eliminating the above discussed drawbacks inherent in the prior art and has for its essential object to provide an improved cylinder lock.

Another important object of the present invention is to provide an improved cylinder lock of the type referred to above where tumblers are depressed to ride the lock portion thereof on the inner peripheral face of the holder so as to make it impossible to pivot the rotor, thus preventing burglary.

Still another object of the present invention is to provide a cylinder lock where it is difficult to manufacture a duplicate key by reading of the heights of the tumblers, or to open the lock by any special means, thus preventing the burglary.

A further object of the present invention is to provide a cylinder lock where the shapes of the key mountains may not be read even if the tumblers are made to move.

In accomplishing these and other objects, according to the present invention, in a cylinder lock are provided a plurality of tumblers inserted slidably into grooves of a rotor, the tumblers being spring urged in a direction to be projected from the external periphery of the rotor. The cylinder lock in adapted to make it impossible to pivot the rotor by the projection of the tumblers into the holder grooves from the external periphery of the rotor when the key is removed and also to make it possible to pivot the rotor with the tumblers engaged within the rotor when the key is inserted. Tooth portions are formed at respective contact portions between the tumbler and the holder inner peripheral face so as to engage the respective tooth portions when the key is removed. If the rotor is attempted to be rotated in the above described construction, the rotor cannot be rotated because of the engagement between the tooth portion of the tumbler and the tooth portion of the inner peripheral face. Therefore, if either of the tumblers is depressed against the urging force of the spring, the tumbler cannot ride on the inner peripheral face of the holder.

According to the present invention, in a cylinder lock are provided a plurality of tumblers inserted slidably into grooves of a rotor, the tumblers being spring urged in a direction to be projected from the external periphery of the rotor. The cylinder lock is adapted to make it impossible to pivot the rotor by the projection of the tumblers into the holder grooves from the external periphery of the rotor when the key is removed, and also to make it possible to pivot the rotor with the tumblers engaged within the rotor when the key is inserted.

The plurality of tumblers are composed of a plurality of types of tumblers, with the key insertion holes being formed in positions corresponding to the heights of the key mountains, the plurality of types of tumblers being composed of a plurality of tumblers different in the positions of the contact portions which regulate the amount of projection from the rotor in contact against inner peripheral face of the holder. By the above described construction, in a condition where the key has been drawn out, the projection amount of each tumbler to be projected in the same direction becomes a height which is not related to the height of the key mountain. Also, the position of the key insertion hole becomes a position which is not related to the height of the key mountain. Thus, if the position of the key insertion hole is detected, the height of the key mountain corresponding to it is not known, so that a duplicate lock cannot be manufactured.

According to the present invention, in a cylinder lock are provided a plurality of tumblers inserted slidably into grooves of a rotor, the tumblers being spring urged in a direction to be projected from the external periphery of the rotor. The cylinder lock is adapted to make it impossible to pivot the rotor by the projection of the tumblers into the holder grooves from the external periphery of the rotor when the key is removed, and also to make it possible to pivot the rotor with the tumblers engaged within the rotor when the key is inserted.

Convex portions, inclined in the axial direction are formed within the grooves of the rotor. The concave portions, each different in depth, are to be engaged with the above described convex portions formed on the plurality of tumblers. According to the above described construction, in the condition where the key has been drawn out the amount of projection of each tumbler to be projected in the same direction becomes a height not related to the height of the key mountain, and also, the position of the key insertion hole becomes also a position which is not related to the height of the key mountain. Therefore, if the position of the key insertion hole is detected, the height of the key mountain corresponding to it is not known, so that a duplicate key cannot be made.

Further, in order to achieve the above described object, in a cylinder lock tumblers having key insertion holes are inserted for free sliding operation within a plurality of grooves provided in a diametrical direction of a rotor retained rotatably within a holder, and is urged in a direction to be projected into the groove portion of the holder from the external periphery of the rotor. The edges of the above described respective key insertion holes, to be depressed by key mountains, are arranged at the same intervals from the center of the rotor. Projections are formed in the groove portion of the holder, provided in a direction opposite to the urging direction of the tumblers so as to make the amount of movement of each tumbler different until each tumbler comes into contact against the projection. Therefore, the above described construction can provide a cylinder lock where the shapes of the key mountains cannot be read even if the tumblers are moved.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
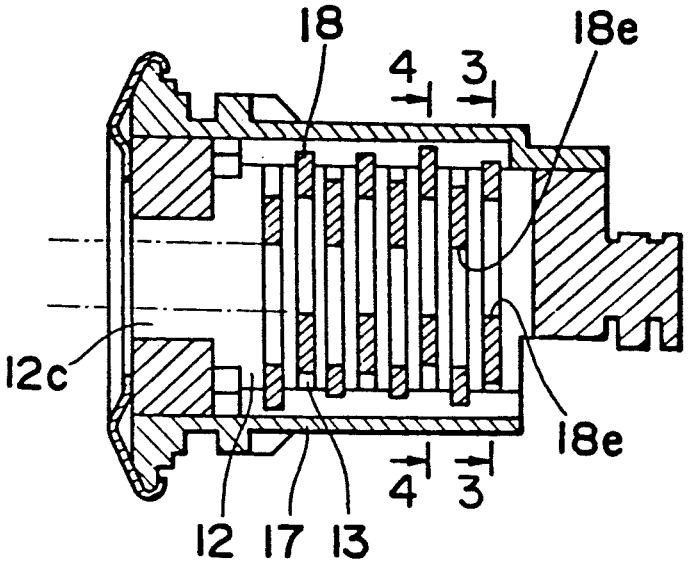
FIG. 1 is a front face sectional view of a cylinder lock in a first embodiment of the present invention.
Figure 2:
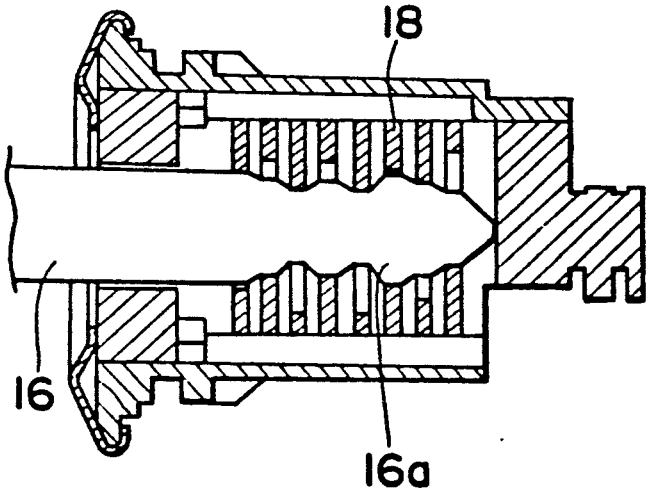
FIG. 2 is a front face sectional view showing a condition where a key in the first embodiment of the present invention is inserted.

Before the description of the present invention proceeds, it is to be noted that like parts are designated by like reference numerals throughout the accompanying drawings.

FIRST EMBODIMENT

Referring now to the drawings, a first embodiment will be described in detail with reference to FIGS. 1 through 4.

In FIG. 1, a pivotable rotor 12 is accommodated within a holder 17, with a plurality of tumblers 18 being retained within the rotor 12. The tumblers 18 are accommodated in the key grooves 13 formed in the diametrical direction of the rotor 12, and are urged in a direction so as to be projected externally from an external peripheral face 12*a* of the rotor 12, with a spring 14 inserted between a convex piece 18*a* projected from the side and a stage portion 12*b* of the rotor 12. When the key 16 is removed, the lock portion 18*b* of the tumbler 18 is projected into a groove 17*a* of the holder 17.

Figure 3:
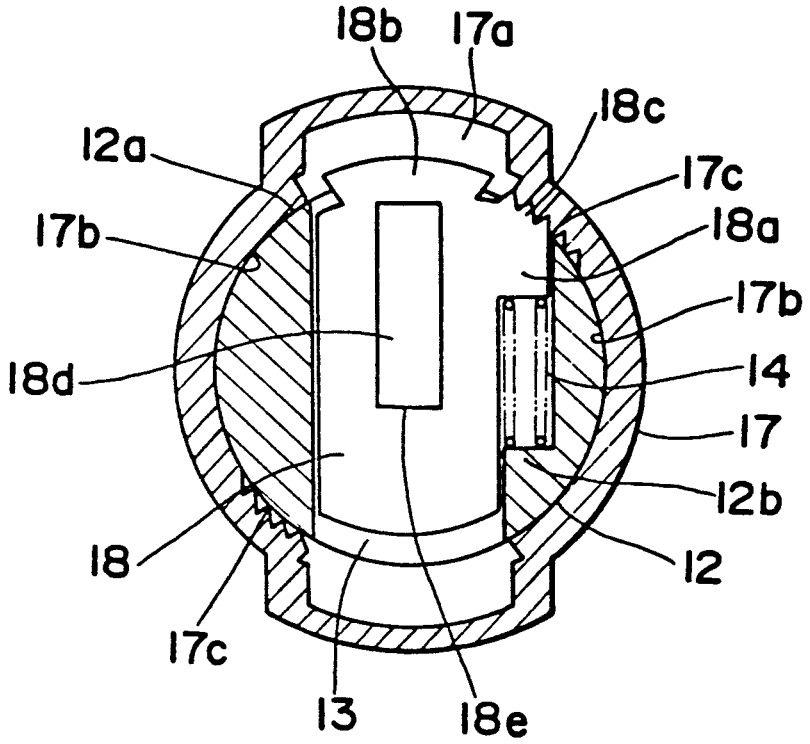
FIG. 3 is a sectional view taken along a line 3—3 of FIG. 1.
Figure 4:
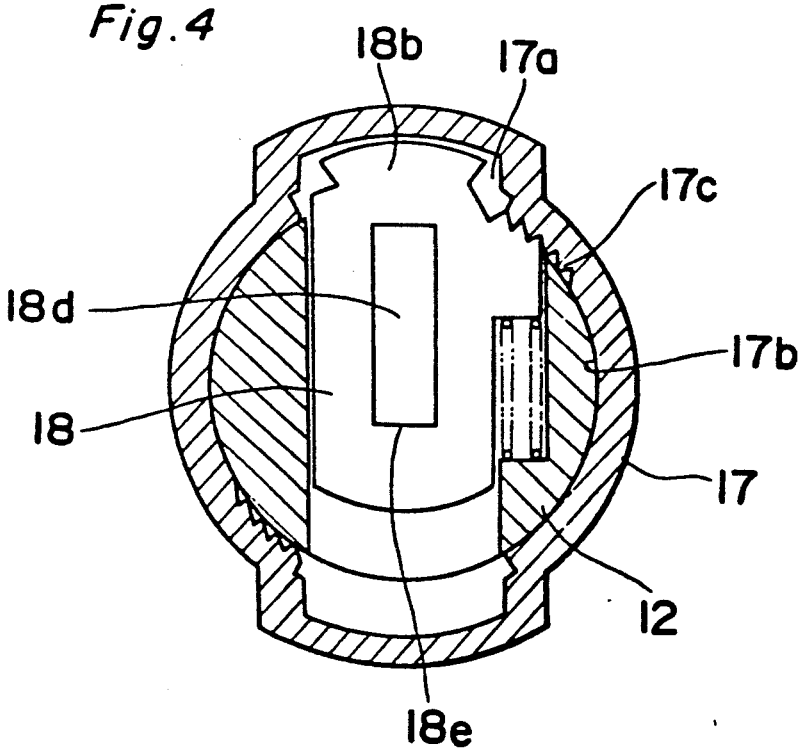
FIG. 4 is a sectional view taken along a line 4—4 of FIG. 1.

Although the above described fundamental construction is not much different from the conventional embodiment, the tumbler 18 in the present embodiment is constructed as described hereinafter. Namely, each of the tumblers is not the same in external shape as shown conventionally A tooth portion 18*c* is formed on the contact portion with the inner peripheral face 17*b* of the holder 17. The projection amount of the lock portion 18*b* varied relative to the position of the tooth portion 18*c*. Namely, although FIGS. 3 and 4 show the tumblers with respect to a key mountain 16*a* of the same height, the tooth portion 18*c* is set in a position so that the projection amount of the lock portion 18*b* is small in FIG. 3, and the projection amount of the lock portion 18*b* is large in FIG. 4. The tooth portions 18*c* are set, respectively, in a plurality of types of positions so that the tumblers 18, with respect to a key mountain of another height, may also be made different in the amount of projection of the lock portion 18*b*. Accordingly, the positions of the key contact face 18*e* when the key is removed, is adapted to be arranged in a position which is not related to the mountain heights of the key 16.

Also, in the present embodiment, a tooth portion 17*c* is formed on the contact portion which comes into contact with the tooth portion 18*c* of the tumbler 18 on the side of the inner peripheral face 17b of the holder 17, so that the tooth portion 17c of the holder 17 and the tooth portion 18c of the tumbler 18 are adapted to be urged by the spring 14 when the key 16 is removed into a condition where they are engaged. Shaking or play between the rotor 12 and the tumblers 18 is controlled within a range where the tip end portion of the tooth portion 18c of the tumbler 18 may not climb over the tip end portion of the tooth portion 17c of the holder 17. Namely, if a tumbler 18 is urged clockwise with the depression thereof, in a condition wherein the rotor 12 is urged clockwise, the tip end portion of the tooth portion 18c of the tumbler 18 is adapted not to be able to climb over the tip end portion on the side of the clockwise direction of the tooth portion 17c of the holder 17.

According to the embodiment, the arrangement of the key insertion hole 18d of the tumbler 18 when the key 16 is removed is no longer related with the height of the key mountain 16a, so that the arrangement of the key mountains can no be recognized if the interior is looked at from the key insertion entrance 12c with a magnifying endoscope or the like.

Also, according to the first embodiment, if any of the tumblers 18 are depressed against the urging force of the spring 14 in a condition where the rotor 12 is urged in the clockwise direction with the use of a jig or the like, the rotor 12 is not pivoted, because the tooth portion 18c of the depressed tumbler 18 cannot climb over the tooth portion 17c of the holder 17, and the rotor 12 cannot be pivoted, because the tooth portion 18c of the other tumblers 18 are engaged with the respective tooth portion 17c of the holder 17.

As is clear from the foregoing description, according to the first embodiment, the respective tooth portions are adapted to be engaged with each other when the key is removed so that the rotor cannot be pivoted even if the tumbler is depressed with the use of a jig or the like. Therefore, the burglary is prevented.

Also, according to the first embodiment, as the arrangement of the key insertion hole is no longer relative to the height of the key mountain in a condition where the key has been removed, the arrangement of the key mountains cannot be recognized even if the interior is looked at from a key insertion opening with the magnifying endoscope or the like, and thus a duplicate key cannot be manufactured. Also, as the movement amount of each tumbler is different, it becomes difficult to pivot the rotor by the depression of the tumbler with a use of the jig or the like. Thus, the safety of the cylinder lock is improved more than before. The lock is not picked by dishonest means, so that damages such as motorcar theft, unlawful entry and so on may be prevented.

SECOND EMBODIMENT

The embodiment of the present invention will be described hereinafter with reference to FIGS. 5 through 8.

Figure 5:
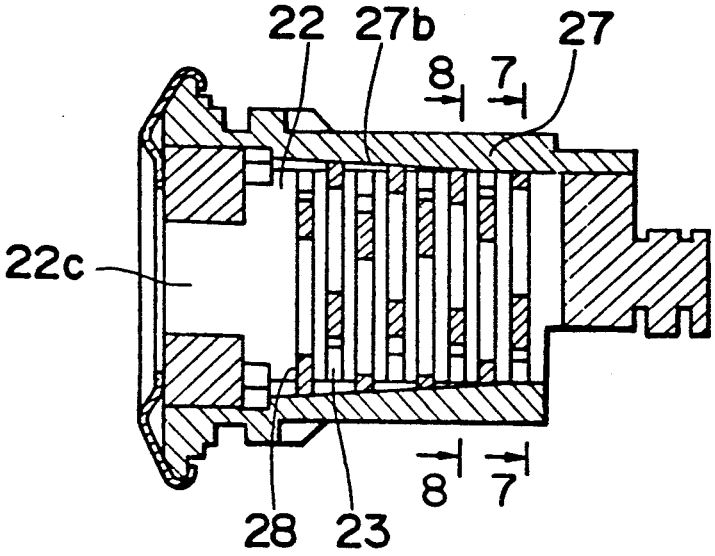
FIG. 5 is a front face sectional view of a cylinder lock of a second embodiment of the present invention.
Figure 6:
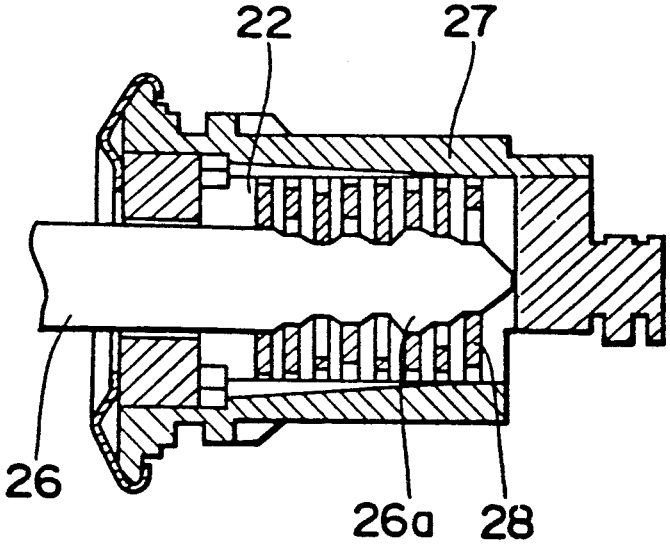
FIG. 6 is a front face sectional view showing a condition where a key of the second embodiment of the present invention is inserted.

In FIG. 5, a pivotable rotor 22 is accommodated within a holder 27, with a plurality of tumblers 28 being retained within the rotor 22. The tumblers 28 are accommodated in key grooves 23 formed in the diametrical direction of the rotor 22, and are urged in a direction to be projected externally from an external peripheral face 22a of the rotor 22 by a spring 24 inserted between a convex piece 28a projected from the side and a stage portion 22b of the rotor 22. When the key 26 is removed, a lock portion 28b of the tumbler 28 is projected into a groove 27a of the holder 27.

Although the above described fundamental construction is not much different from the conventional embodiment, a convex portion 27b is provided within the groove 27a of the holder 27 in the present embodiment. Concave portions 28c and 28d are formed in the top end and the bottom end of the tumbler 28. The convex portion 27b is inclined so that the height thereof may become higher gradually from the front face of the key insertion opening 22c towards the interior. The concave portions 28c and 28d are formed in positions opposite to the above described convex portion 27b, namely, in the central portion of the lock portion 28b and on the opposite side thereof.

Figure 7:
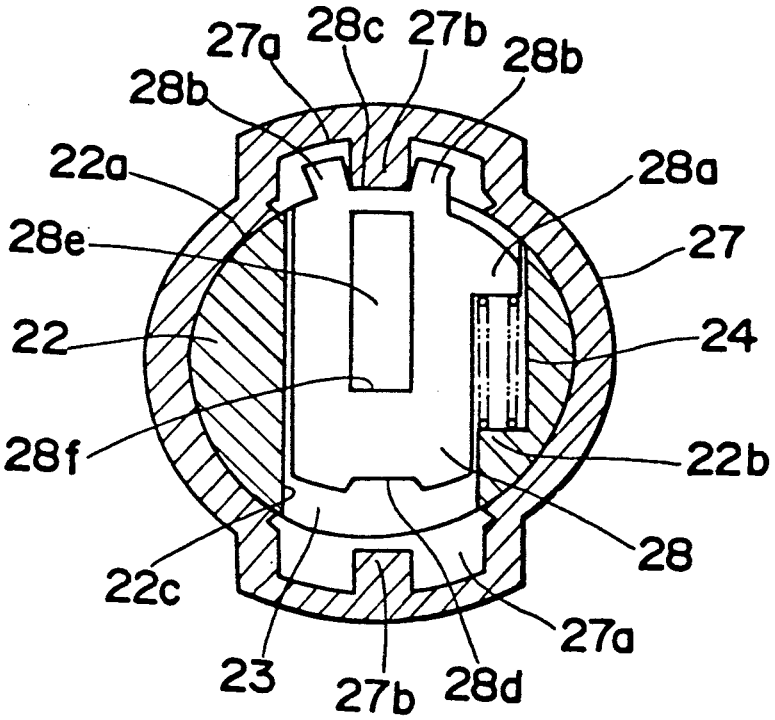
FIG. 7 is a sectional view taken along a line 7—7 of FIG. 5.
Figure 8:
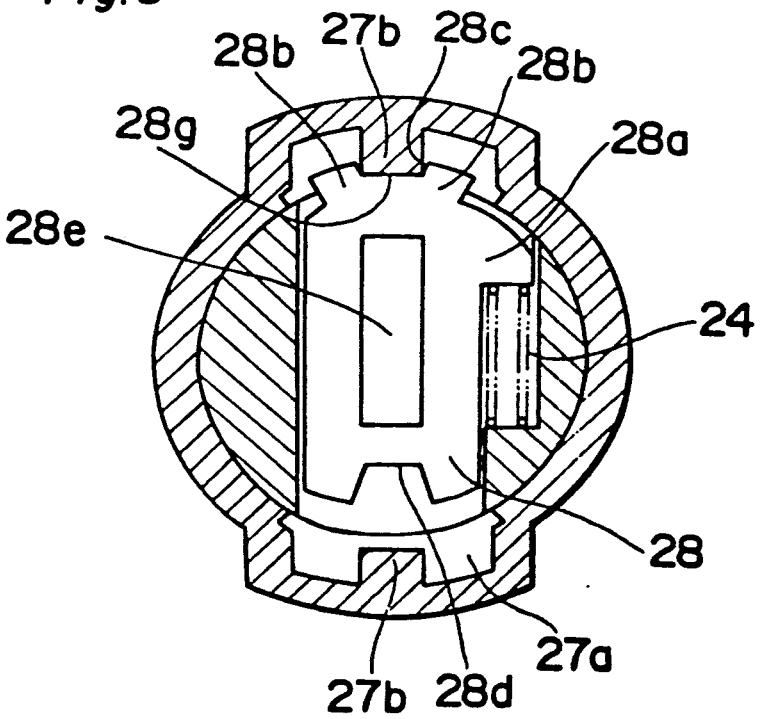
FIG. 8 is a sectional view taken along a line 8—8 of FIG. 5.
Figure 9:
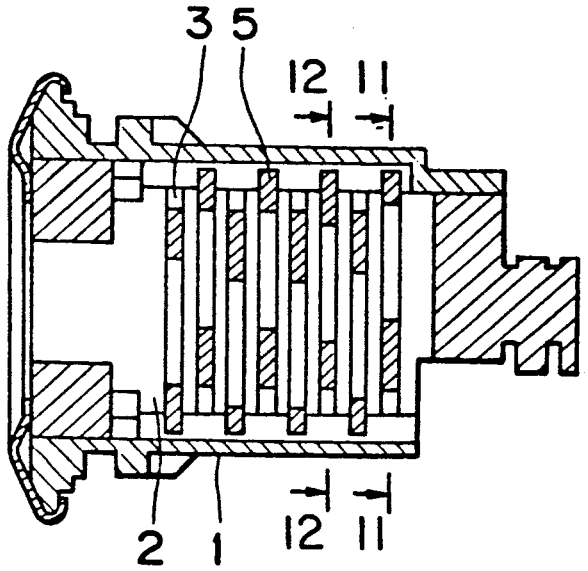
Fig.9 PRIOR ART
FIG. 9 is a front face sectional view of a conventional cylinder lock.
Figure 10:
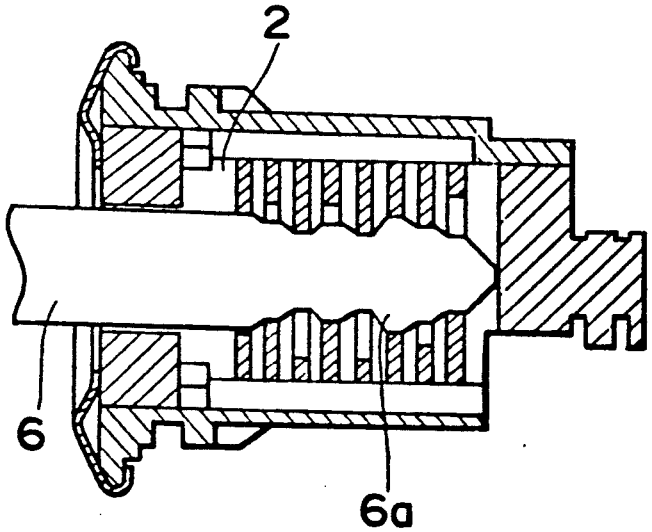
Fig.10 PRIOR ART
FIG. 10 is a front face sectional view showing a condition where the key of the conventional cylinder lock is inserted.
Figure 11:
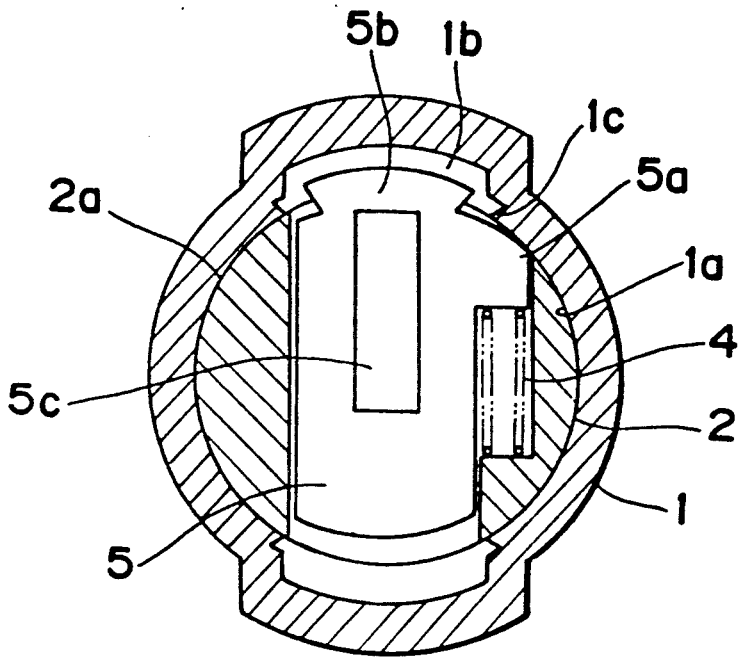
Fig.11 PRIOR ART
FIG. 11 is a sectional view taken along a line 11—11 of FIG. 9.
Figure 12:
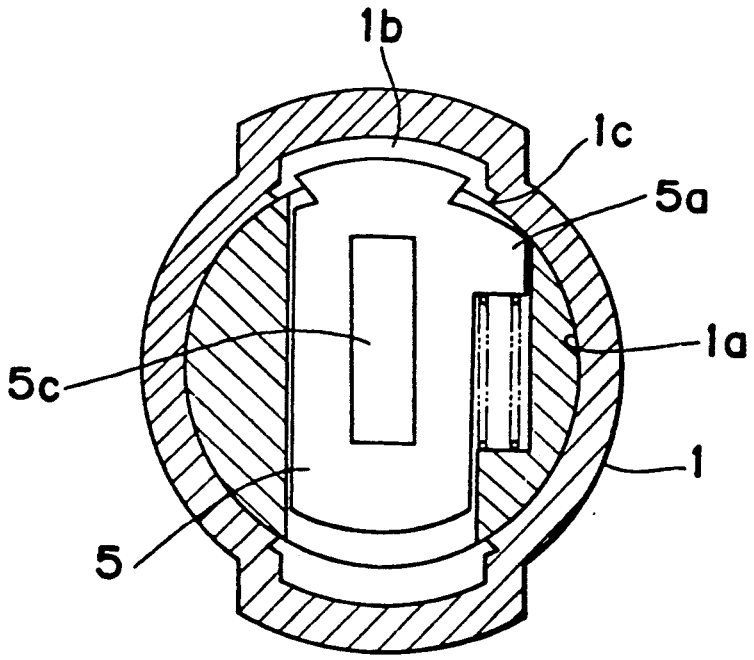
Fig.12 PRIOR ART
FIG. 12 is a sectional view taken along a line 12—12 of FIG. 9.

The above described concave portions 28c, and 28d are different in the depth thereof depending upon the respective tumblers 28 (See FIGS. 7 and 8). If the tumbler 28 is projected into the groove 27a, the bottom portion of the concave portion 28c is adapted to come into contact against the tip end portion of the convex portion 27b. Before the tumbler 28 comes into contact against the bottom face of the groove 27a of the holder 27, the convex portion 27b comes into contact against the bottom portion of the concave portion 28c. Therefore, although a gap is produced between the tumbler 28 and the bottom face of the above described groove 27a, the gap is different in each tumbler 28, and becomes an arrangement which is not related to key mountains 26a. Accordingly, if the tumblers 28 are examined by a magnifying endoscope or the like, the shape of the key mountains 26a cannot be read, because the tumblers 28 do not correspond to the differences in the height of the key mountains. In addition, as the convex portion 27b is formed to be inclined so as to be gradually changed, the tumblers 28 are arranged in further complicated positions so that the shape of the key mountains 26a is too difficult to read.

Also, if the tumblers 28 are moved by the depression of the edge 28f of the key insertion hole 28e of the tumbler 28 through the insertion of a wire or the like through the key insertion opening 22c, the shape of the key mountain 26a cannot be read through the comparison in the movement amount of the tumbler 28 and the positional relation of the contacted position, because the convex portion 27b comes into contact against the bottom portion of the concave portion 28d before the tumbler 28 comes into contact against the bottom face of the groove 27a of the holder 27, as in the above description.

Further, in the present embodiment, if either of the tumblers 28 is depressed in a condition where the rotor 22 is urged in a clockwise direction with the use of the jig or the like, the pivoting range thereof is regulated by the other tumblers 28. The tip end portion of the lock portion 28b of the tumbler 28 cannot climb over the inner peripheral face of the holder 27, and further, the tip end portion of the lock portion 28b cannot climb over the tip end portion of the convex portion 27b, because the sides of the concave portions 28c, and 28d of the tumbler 28 are inclined in form. Therefore, the rotor 22 cannot be pivoted.

As is clear from the above description, according to the second embodiment, the arrangement of the key insertion hole of the tumblers is not related with the height of the key mountains in the state where the key has been drawn out. The arrangement of the key mountains thus cannot be recognized if the interior is looked at from the key insertion opening with a magnifying endoscope or the like, so that a duplicate key cannot be manufactured. Therefore, the safety of the cylinder lock is improved more than before. The lock can not be picked by a dishonest means, so that damages such as motorcar theft, unlawful entry and so on may be prevented.

Also, in the cylinder lock in accordance with the present invention, the movement amount in the direction opposite to the urging direction of each tumbler is varied.

Accordingly, if any comparison is made in the movement amount thereof, or the height of the edge of the key insertion hole by the movement in the direction opposite to the urging direction of each tumbler, with, for example, wire or the like, the shape of the key mountains cannot be read, because the tumblers do not correspond to the differences in the height of the actual key mountains. As a result, theft by the making of a duplicate key may be prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A cylinder lock, comprising:

a cylinder lock holder;

a rotor in said cylinder lock holder for engagement by a key for turning said rotor in said cylinder lock holder, said rotor having a plurality of grooves therein;

a plurality of tumblers slidably disposed in respective said grooves of said rotor;

holder grooves in said cylinder lock holder for receiving said tumblers;

means for enabling the rotation of said rotor in said cylinder lock holder in response to the insertion of a key into said rotor by causing said tumblers to be retracted from said holder grooves and for disabling rotation of said rotor in said cylinder lock holder in response to the removal of a key from said rotor by causing said tumblers to be projected into said holder grooves; and wherein each said tumbler has a range of movement between a first position whereat said tumbler is retracted into said rotor and a second position whereat said tumbler is projected into a said holder groove, said range of movement varying substantially for a plurality of said tumblers, whereby duplication of the key for said cylinder lock by examination of the positions of said tumblers when a key is removed from said rotor is prevented;

wherein said range of movement of each said tumbler is defined by concave portions on respective said tumblers at ends thereof engaging said holder grooves, a plurality of said concave portions varying substantially in depth in order to vary the amount of projection of said tumblers into said holder grooves and thus vary said range of movement, and convex portions extending in said holder grooves of said cylindrical lock holder, said convex portions tapering in the direction of the axis of said cylindrical lock holder.

2. The cylinder lock of claim 1, wherein said means for enabling and disabling the rotation of said rotor comprises a spring means for biasing said tumblers to be projected toward said holder grooves.

3. The cylinder lock of claim 2, wherein said means for enabling and disabling the rotation of said rotor further comprises a plurality of key insertion holes in respective said tumblers.

4. A cylinder lock, comprising:

a cylinder lock holder;

a rotor in said cylinder lock holder for engagement by a key for turning said rotor in said cylinder lock holder, said rotor having a plurality of grooves therein;

a plurality of tumblers slidably disposed in respective said grooves of said rotor;

holder grooves in said cylinder lock holder for receiving said tumblers;

means for enabling the rotation of said rotor in said cylinder lock holder in response to the insertion of a key into said rotor by causing said tumblers to be retracted from said holder grooves and for disabling rotation of said rotor in said cylinder lock holder in response to the removal of a key from said rotor by causing said tumblers to be projected into said holder grooves;

convex portions extending in said holder grooves of said cylindrical lock holder, said convex portions tapering in the direction of the axis of said cylindrical lock holder; and concave portions of respective said tumblers at ends thereof engaging said convex portions of said holder grooves when said tumblers are projected into said holder grooves, a plurality of said concave portions varying substantially in depth in order to vary the amount of projection of said tumblers into said holder grooves, whereby the range of movement varies substantially among said plurality of tumblers.

5. The cylinder lock of claim 4, wherein said means for enabling and disabling the rotation of said rotor comprises a spring means for biasing said tumblers to be projected toward the holder grooves.

* * * * *